United States Patent [19]

Fogt

[11] 4,142,377

[45] Mar. 6, 1979

[54] ICE MAKER FLEXIBLE TRAY CONSTRUCTION

[75] Inventor: Thomas H. Fogt, West Carrollton, Ohio

[73] Assignee: General Motors Corporation, Detroit, Mich.

[21] Appl. No.: 856,918

[22] Filed: Dec. 2, 1977

[51] Int. Cl.[2] ..... F25C 1/10

[52] U.S. Cl. ..... 62/135; 62/353

[58] Field of Search ..... 62/135, 353; 73/361

[56] References Cited

U.S. PATENT DOCUMENTS

| | | | |
|---|---|---|---|
| 3,540,227 | 11/1970 | Eyman, Jr. | 62/353 |
| 3,775,992 | 12/1973 | Bright | 62/353 |
| 4,002,041 | 1/1977 | Canter | 62/135 |

*Primary Examiner*—Reinaldo P. Machado
*Attorney, Agent, or Firm*—Edward P. Barthel

[57] ABSTRACT

A flexible ice tray for an automatic ice maker allowing improved temperature sensing and ice harvesting. An inverted channel is formed in the bottom wall of at least first and second ice cube sensing pockets along the tray's axis of rotation. A separate member, in the form of a rectangular sectioned block of insulation, is removably positioned on the underside of the tray and cooperates with the inverted channel to define a sensing well for enclosing a temperature sensor tube positioned on the rotational axis. The tube sensor is insulated so as to respond only to the change in temperature in the first and second pockets, while the block prevents rapid bottom freezing of the cubes being sensed. The block is retained in a shiftable manner with respect to the tray to provide substantially uniform stiffness for all the tray pockets whereby twisting of the tray allows flexing of the sensing pockets to insure the release of the ice pieces formed therein.

1 Claim, 11 Drawing Figures

ICE MAKER FLEXIBLE TRAY CONSTRUCTION

This invention relates to tray ice makers and is directed to an improved flexible tray for an automatic ice maker.

While automatic ice makers for houshold refrigerators have been commercially successful, difficulties have been encountered in securing reliability of operation under all conditions, combined with low cost and adequate capacity. An example of such a successful automatic ice maker is shown in the U.S. Pat. No. 3,540,227, issued Nov. 17, 1970 to C. W. Eyman, Jr. et al., and assigned to the assignee of the instant application. The Eyman ice maker utilizes a flexible ice tray having a thermal bulb well or sensing cavity formed on the underside thereof coaxial with a boss integral with the tray and located between the tray front or forwardmost ice cube pockets. A lower insulating air space is formed between the boss outer wall and the cavity inner wall to shield the sensing tube portion of a hydraulic thermostat located in the well from the cold circulating air of the refrigerator freezer compartment. Such a sensing well is shown in detail in U.S. Pat. No. 4,002,041, issued Jan. 11, 1977 to J. A. Canter and assigned to the same assignee as the present application. The outer wall formed around the sensing well acts to stiffen the tray in the forward area of the sensed pockets resulting in insufficient flexing of the tray to insure release of the cubes therein during the ice harvesting cycle.

It is accordingly an object of the present invention to provide for an improved ice maker flexible tray having substantially uniform stiffness for all the tray pockets such that all the cubes may be released when the tray is flexed or twisted during the ice harvesting cycle.

Another object of the present invention is to provide an improved automatic ice maker flexible tray having an inverted channel formed in the bottom wall of the first and second temperature sensing pockets extending longitudinally along the axis of rotation of the tray, whereby a plastic insulating block located on the underside of the tray cooperates with the inverted channel to define a sensing well for enclosing a temperature sensor tube, and such that the tube sensor is insulated from the freezer compartment so as to respond only to the change in temperature in said first and second pockets while the insulating block also allows the smaller cubes in the pockets being sensed to be frozen at substantially the same time as the remaining cubes in the tray, thus preventing smaller sensed cubes from freezing first which may result in a harvest cycle occurring before the remaining larger sized cubes are frozen.

These and other objects of the present invention will become apparent from the following description, reference being had to the accompanying drawings, wherein a preferred embodiment of the present invention is clearly shown.

Figure 1:
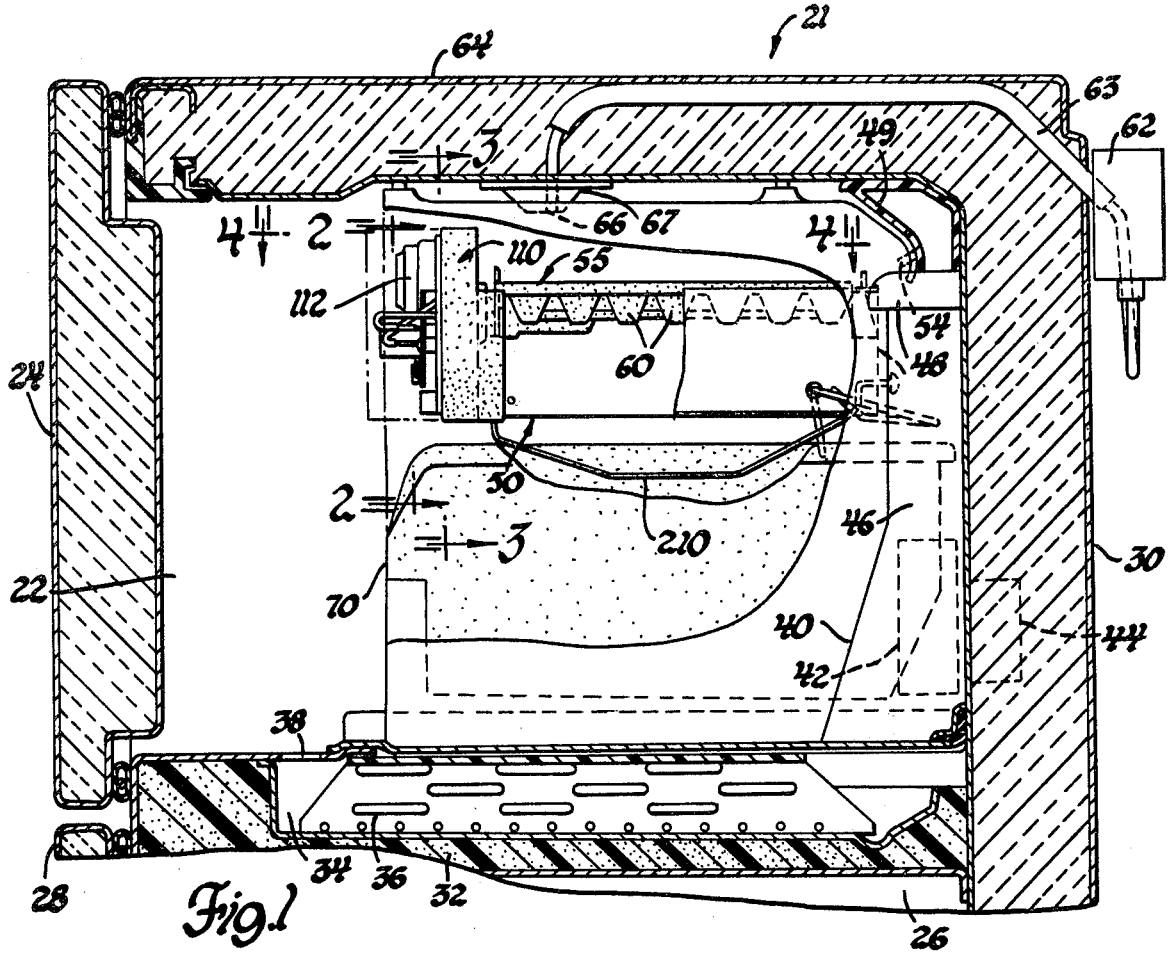
FIG. 1 is an irregular vertical sectional view through a refrigerator freezer compartment embodying an air cooled automatic ice maker illustrating the invention.
Figure 2:
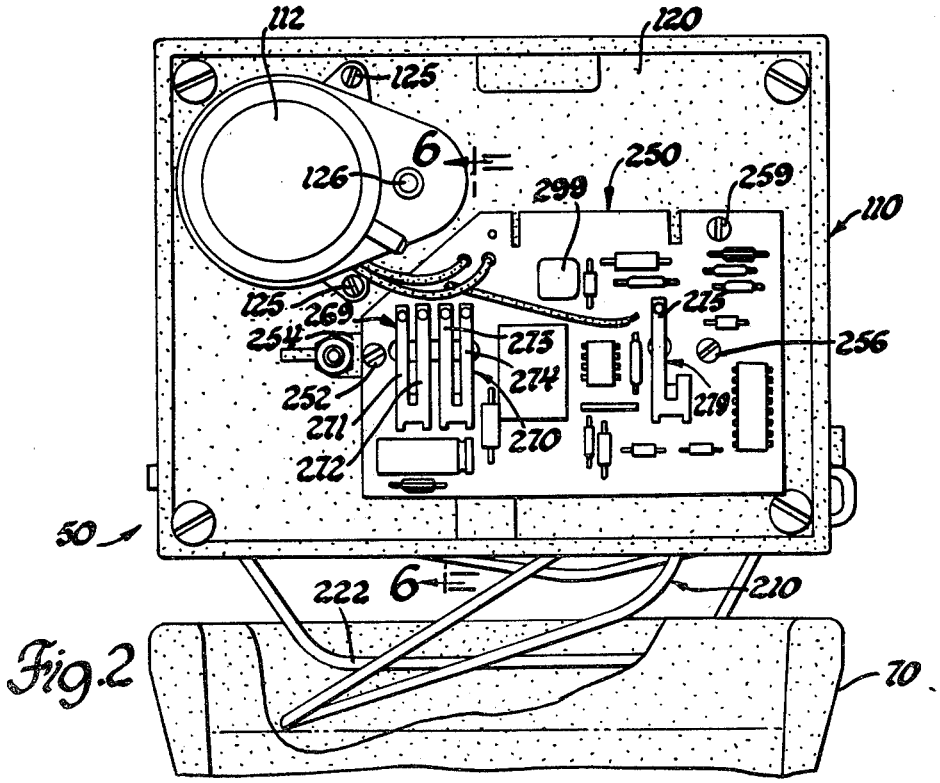
FIG. 2 is an enlarged fragmentary vertical elevational view taken along the line 2—2 of FIG. 1.

Referring now to the drawings and more particularly to FIG. 1, there is shown the upper portion of a frost-free household refrigerator 21 with an upper below-freezing compartment 22 closed by an insulated door 24 and a lower above-freezing compartment 26 closed by lower insulated door 28. These compartments are surrounded by insulated side, top, bottom and rear walls 30 separated by horizontal insulated partition walls 32 incorporating an evaporator compartment 34, supporting an evaporator 36 having vertical fins extending from the front to the rear of the compartment 34. The evaporator compartment 34 is provided with an inlet 38 at the front communicating with the front of the below-freezing compartment 22 and additional inlets (not shown) communicating with the top of the above-freezing compartment 26. At the rear, the evaporator compartment 34 connects with a shroud 40 communicating with the entrance of a centrifugal fan 42 which is driven by an electric motor 44 housed in the rear wall of the cabinet. The cooling system for the compartments 22 and 26 may be of conventional construction such as that shown in U.S. Pat. No. 3,359,750, issued Dec. 26, 1967 or U.S. Pat. No. 3,310,957 issued Mar. 28, 1967; owned by the assignee of the present application. These patents may be referred to for further details of construction of the refrigerator.

The fan 42 is provided with an upwardly extending discharge duct 46 having a distributor 48 at the top which distributes the discharge of chilled air through the below-freezing compartment 22. The evaporator 36 is operated at suitable below-freezing temperatures in the range of −5° to −15° F. to maintain the freezer compartment 22 at a temperature of 0° F. or below.

Special cooling for the freezer compartment 22 is provided in the form of discharge duct 49 extending laterally along the intersection of the rear and top walls in communication with the distributor 48. Behind the automatic ice maker, generally indicated at 50, the laterally extending duct 49 is provided with a wide discharge nozzle 54 which distributes cold air evenly such that it flows over the top of the plastic ice piece forming mold or ice tray 55.

Figure 4:
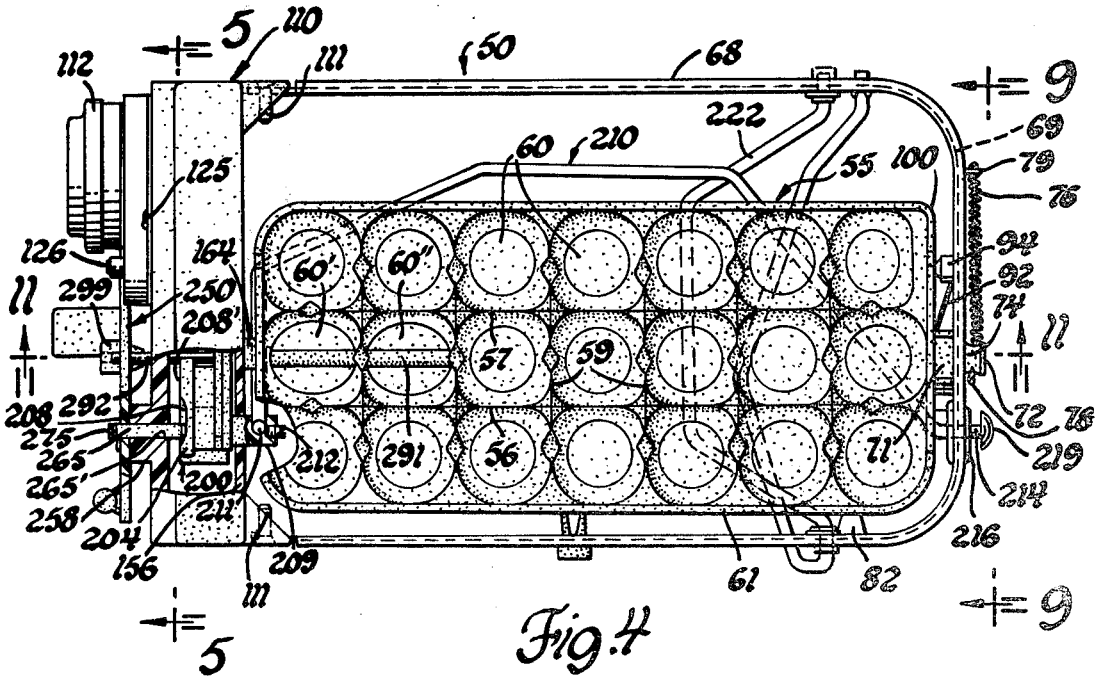
FIG. 4 is an enlarged elevational view taken along the line 4—4 of FIG. 1 of the automatic ice maker with parts broken away.
Figure 7:
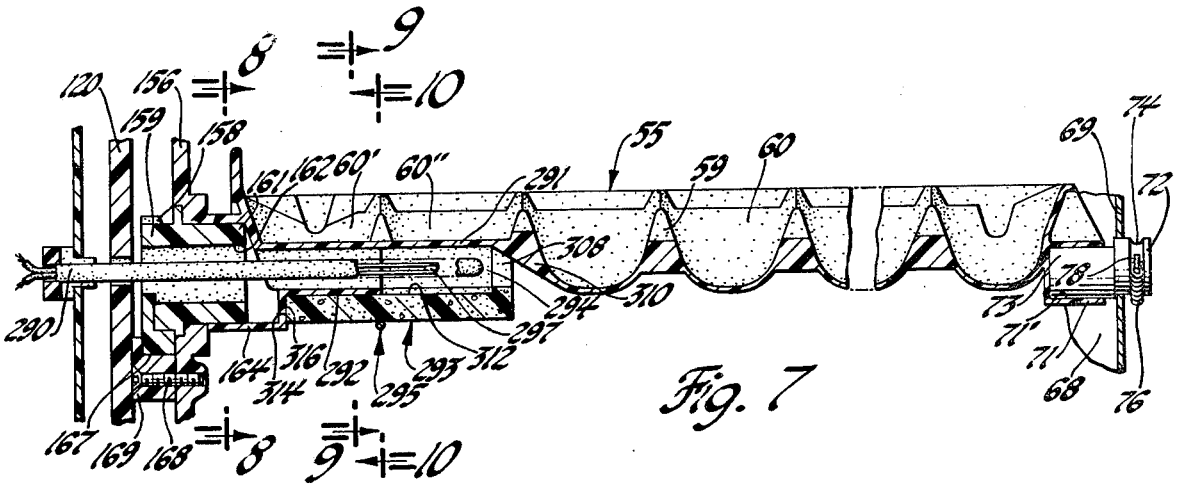
FIG. 7 is a fragmentary sectional view taken along the line 7—7 of FIG. 4.
Figure 9:
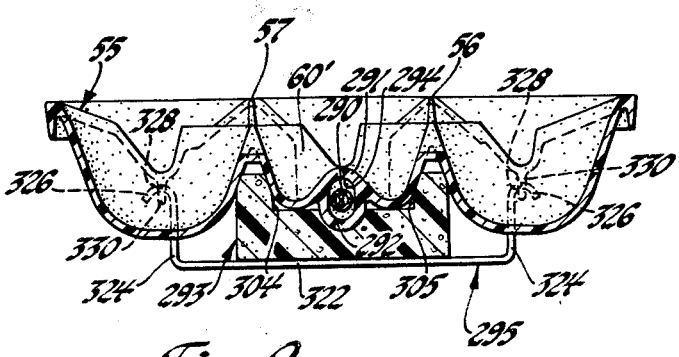
FIG. 9 is an enlarged vertical sectional view taken along the line 9—9 of FIG. 7.

As shown in FIGS. 4, 7 and 9, the tray 55 has a pair of longitudinal dividing walls 56 and 57 and six transverse dividing walls 59 which section the interior of the tray into 21 pockets 60, i.e. three longitudinal rows having seven pockets 60. The tray 55 has upwardly flanged rim 61 extending around its short and long sides. The tray 55 is supplied with water from a pressure water system or other liquid under pressure to a solenoid control valve 62 which controls the flow of water through a tube 63 extending through the insulation adjacent outer shell top wall 64 to position a discharge nozzle 66 in the top liner wall of compartment 22. The nozzle 66 extends through a heater bracket 67 so as to be positioned above the front center pockets of the tray 55.

Figure 3:
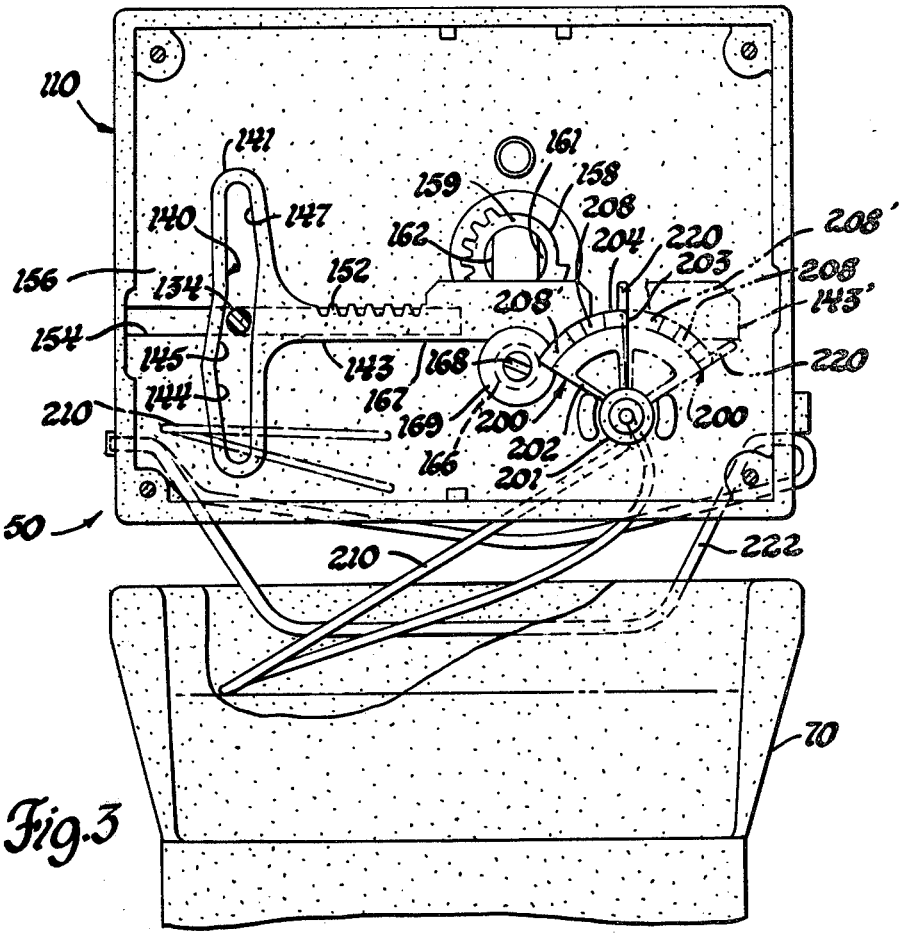
FIG. 3 is an enlarged fragmentary vertical elevational view of the ice maker of FIG. 1, with the inner cover plate removed, taken along the line 3—3 of FIG. 1.

As seen in FIG. 4, the ice maker 50 is provided with a wide U-shaped frame 68 which surrounds the tray 55. The frame 68 may be fastened to the adjacent liner side wall of the freezer compartment 22 by a suitable fastening means such as screws (not shown). In FIGS. 1 and 3 there is shown seated directly below the frame 68 a rectangular bin or ice container 70 for receiving the frozen ice pieces or "cubes" released and ejected from the tray 55 in a manner to be described.

Figure 5:
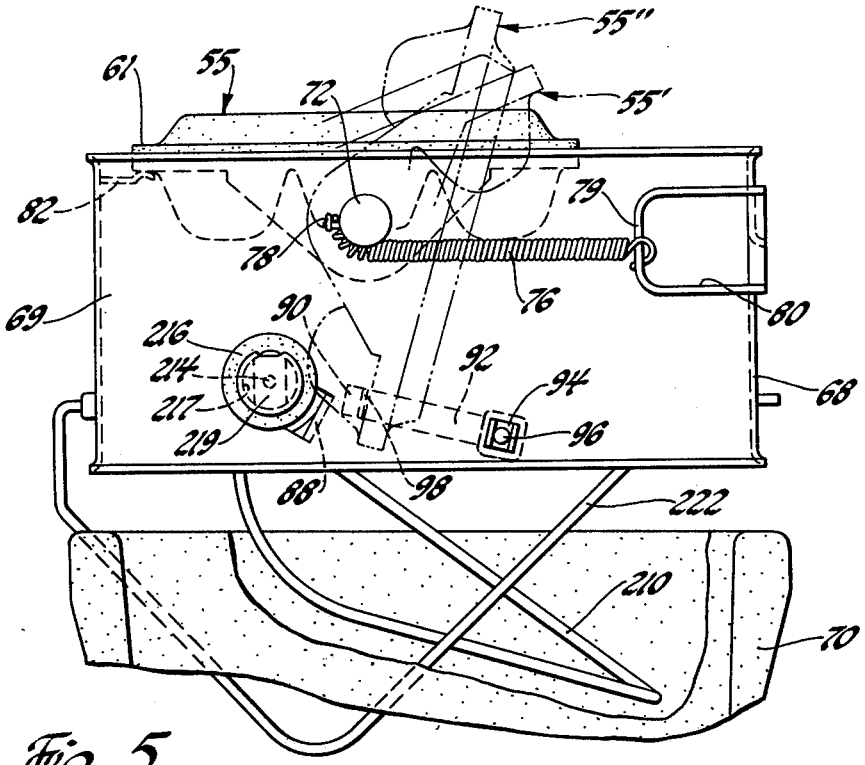
FIG. 5 is a view taken on line 5—5 of FIG. 4.
Figure 6:
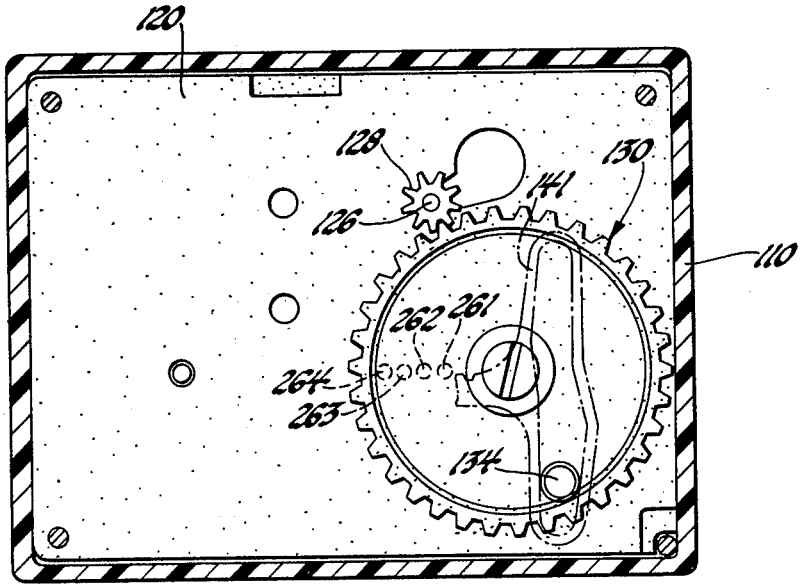
FIG. 6 is an enlarged vertical sectional view taken on the line 6—6 of FIG. 4.

With reference now to FIGS. 4, 5 and 7, integrally molded on the back wall of tray 55 is a boss 71 provided with a semi-cylindrical recess 71' tightly receiving a complementary semi-cylindrical portion 73 of a coaxial projecting pin 72. The pin outer portion is cylindrical providing a bearing portion fitting a circular aperture in the rear wall 69 of the frame 68. As seen in FIG. 4, the pin 72 outer portion is provided with an annular groove 74 around which is wrapped a portion of a tension coil spring 76 with the spring having one end hooked by means of hook 78 projecting from the groove 74, with the opposite end of the spring 76 hooked to a lanced-out tab 79 in the rear wall of the frame 68 adjacent the horizontally disposed slot 80 (FIG. 5). The frame may also be provided with a stop 82 which is lanced out of the frame side wall and extends into the path of movement of an adjacent portion of the tray rim 61 to stop the tray rotation in a horizontal position in the direction of the turning force applied by the tension spring 76.

As explained in the above-mentioned Eyman U.S. Pat. No. 3,540,227, to insure the release and ejection of all the frozen cubes from the tray 55, an initial counterclockwise reverse twist is given to the tray (indicated at 55' in FIG. 5) followed by rotation of the tray in the opposite or clockwise direction to its phantom line position 55''. The tray's clockwise rotation is momentarily halted at its position 55'' by a spring detent, generally indicated at 90 in FIG. 5, which comprises a leap spring 92 secured on the inside of the frame 68 by a plastic spacer insert 94 and expanding screw 96. The leaf spring main portion extends at an angle of about 30° toward the tray and terminates in a Z-shaped end portion 98. The tray 55 has a small radiused rear corner 100 (FIG. 4) shaped to ride out of the "Z 38 98 in a "sudden" manner from its position 55'' and under the resilient force provided by a predetermined "second twist" causing the plastic tray to accelerate from its phantom line position 55'' into contact with stop 88 to assist in the ejection of the ice pieces from the tray 55.

As viewed in FIGS. 1 and 4, all the mechanism and controls for the automatic ice maker 50 are arranged so as to be accessible at the front of the refrigerator with the tray rotating and twisting mechanism being located in mechanism housing 110 suitably secured to the frame 68 as by screws 111. An electric driving motor 112 and an electrical circuit board assembly 250 are enclosed by a removed outer housing cover indicated by phantom lines 116 in FIG. 1. The outer cover 116 and housing 110, both of which are formed from suitable plastic material, define a rear compartment 122 and a front compartment 124. The drive motor 112 is supported by screws 125 on the cover plate 120 with the motor final drive shaft 126, which extends through the cover plate 120, having a drive pinion gear 128 on the opposite side of the cover plate which gear continually meshes with a large driven crank gear 130.

As best seen in FIGS. 3 and 5, the large gear 130 rear face 132 is provided with an eccentrically located crank pin 134 which extends into an elongated irregular loop 140 of an upright yoke 141 molded integrally with a horizontal rack bar 143 in a manner similar to a scotch yoke mechanism. As explained in the U.S. Pat. No. 3,926,007 issued Dec. 16, 1975, to R. S. Braden et al, and assigned to the assignee of the present application, the difference from a true scotch yoke mechanism resides in the fact that the surfaces of the yoke loop 140, contacted by the crank pin 134, are not all perpendicular to the rack bar, and in particular the yoke includes angular cam surfaces 144 and 145 in the side opposite the bar 143 and an inclined surface 147 on the side adjacent the bar 143. The rack bar 143 includes six full teeth 152 adjacent to the yoke.

FIG. 3 shows the rack bar 143 is slidably mounted in a horizontal groove 154 provided in the adjacent rear wall 156 of the rear housing 110. The rack bar 143 and its teeth 152 cooperate with an interrupted pinion 158, provided on the front end of a coaxial pinion or spur gear sleeve 159 (FIG. 7) which sleeve is rotatably mounted in bearing means provided in the housing rear wall 156. The sleeve 159 has a coaxial rearward hollow projection 161, having flattened side inner surfaces 162 and flattened outer side surfaces (not shown) which fit within a tray boss 164 (FIGS. 4 and 7) located in longitudinal alignment with the center row of pockets 60 of the tray 55 and containing a complementary recess receiving the projection 161. The rack bar 143 is held in engagement with the pinion 158 by suitable means such as bushing 166 contacting the bar's bottom surface 167. The bar 143 is retained by bushing screw 168 threading into the housing rear wall 156 with screw washer 169 guiding the outer surface of the bar 143.

As explained in the mentioned Eyman patent the crank pin 134 cooperates with the yoke loop 140, via rack bar teeth 152 at the left hand position of the bar's stroke (FIG. 3), to provide an initial reverse twist of about 28° to the front end of the tray 55, indicated in phantom at 55' in FIG. 5. The mechanism cooperates after the initial twist to rotate and invert the tray 55 until after about 140° the rear of the tray 55 engages the stop 88. The rotation continues to finally twist the tray until it completes a twist of about 28° opposite to the initial twist.

As best seen in FIGS. 3 and 4, a sensing arm holder and camshaft member, generally indicated at 200, includes a hub 201 formed with a pair of radially extending spokes 202 and 203 supporting an integral arcuate cam carrier 204. An arcuate cam track 208 is formed on the forward face of the cam carrier 204 including an arcuate raised cam lobe 208' portion thereon. The cam shaft 200 hub has a stub shaft 209 pivotally received in a circular opening in the housing rear wall 156 with the shaft 209 including a transverse bore extending therethrough, receiving the outer radial end 211 of an ice level sensing and shutoff arm 210 retained in the bore by suitable means such as by an adjusting set screw 212. As seen in FIG. 4, the rearward free end 214 of the arm 210 is pivotally mounted in the frame rear wall 69 by suitable means such as a plastic grommet 216 inserted in the aperture 217 such that the sensing arm end 214 is in axial alignment with the stub shaft 209. A removable retaining button 219 is inserted on the sensing arm free end 214 for permitting the disassembly thereof.

As seen in FIG. 3, as the rack bar 143 moves to the right it engages radial finger 220, formed as an extension of radial camshaft spoke 203, causing the finger 220 to be rotated to its dashed line position. This movement in turn rotates the sensing arm 210 through a predetermined arc of about 30° from its gravity biased solid line lower portion to its upper retracted dashed-line position free of the ice bin. It will be noted that in unison with the raising of arm 210 the ice tray 55 is rotated clockwise, as viewed in FIG. 9, to its forward twist and ice cube ejection position, allowing the freed ice cubes to fall from the tray into the bin 70.

Upon the rack bar 143 being returned to its FIG. 3 location, by means of the crank pin 134 and the yoke arrangement returning the tray 55 to its horizontal position, the sensing arm 210 is free to rotate in a downward arc from its retracted upper position to its solid line lower position in the bin 70. If, however, the ice piece accumulation in the bin 70 has reached a predetermined maximum level, the sensing shut-off arm 210 is stopped by the ice pieces, therefore preventing the sensing arm arcuate cam from closing an ice level switching arrangement to be described. Thus, the ice maker cannot now initiate a harvest cycle until the sensing arm 210 is free to drop or fall to its full line position and actuate the switching arrangement. A torsion spring rod 222 provides for automatic shutoff of the ice maker when the bin 70 is withdrawn from the freezer compartment by retracting the sensing arm from the bin as shown and described in U.S. Pat. No. 3,926,007 issued Dec. 16, 1975 and assigned to the assignee of this application.

Turning now to the subject of the present invention wherein FIG. 7 shows applicant's improved flexible tray structure. An axially extending elongated sensing tube 290, preferably made from Nylon, extends into an inverted channel 291 formed in the bottom portion of tray sensing pockets 60' and 60''. The tray is formed with an open-ended arcuate wall or semi-cylindrical tray guide portion 292 in communication with central cavity or hollow projection 161. The guide portion 292 encloses only the portion of the inverted channel 291 formed in the first pocket 60' to form a tube-like guide. As seen in FIG. 7, the sensing tube 290 extends sufficiently through the central cavity 161 and guide portion 292 to position temperature sensing means, which in the discloses form is a temperature sensitive resistor or thermistor 297, in the portion of the inverted channel 291 formed in the bottom wall of the sensing pocket 60''. The ice maker control circuit which includes the thermistor sensor is disclosed in co-pending U.S. Patent Application Ser. No. 856,786 and reference may be made to that application for a detailed description of the control circuit.

Figure 11:
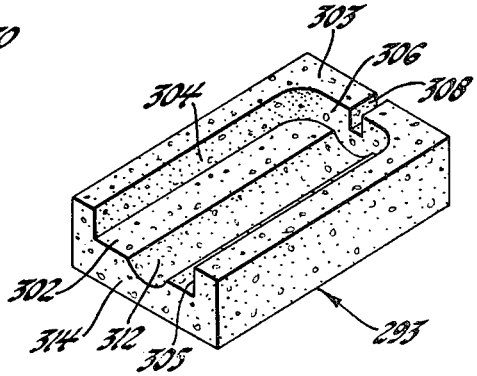
FIG. 11 is a perspective view of the insulation block of the present invention.

FIG. 11 shows a plastic rectangular sectioned insulation block 293, preferably formed from expanded polystyrene, which has a length at least as long as the inverted channel 291. The block 293 is shown positioned on the underside of the tray's center row of pockets to provide a cover for the inverted channel 291 thereby to enclose in sensing well 294 the rearward portion of the tube 290 containing the sensor 297 outside the guide 292 and adjacent the sensing pocket 60''. The block 293 has a recessed portion 302 formed in its upper surface 303. The recess is defined by peripheral side walls 304, 305 and back wall 306 which walls are dimensioned to conform to the underside of the first 60' and second 60'' sensing pockets. It will be noted that the block back wall 306 is formed with a notched-out portion 308 located on the block longitudinal medial plane with the notch dimensioned to receive therein a longitudinal web 310 formed between the tray's sensing pocket 60'' and next adjacent full or normal size pocket 60. Further, it will be seen in FIG. 11 that the block recess 302 has a radiused out trough 312 conforming to the outer contour of the guide 292. Also, block forward wall 314 abuts or seats against the rear face 316 of tray boss 164 to acurately position the block longitudinally on the tray.

In this manner the block 293 operates to close the portion of the inverted channel 291 formed in the bottom wall of the second pocket 60'' so as to isolate the temperature sensor 297 in a sensing cavity or well 294. The result is that the temperature sensor 297 is sensitive only to the temperature of the liquid charge in the second sensing pocket 60''. It will be appreciated that the insulation block 293 is operative to insulate the bottom walls of the center row first 60' and second 60'' pockets thereby insuring that the charge of water therein is not frozen into a solid ice piece prior to the freezing of the water in the remaining tray pockets 60 into solid ice pieces. The importance of applicant's sensing well design arises, in part, because sensing pockets 60' and 60'' have a smaller liquid capacity than the full sized tray pockets 60. As a consequence water in pockets 60' and 60'' tends to freeze faster than the larger volume of water in the tray pockets 60. Thus, the insulation block 293 causes the water in sensing pockets 60' and 60'' to freeze primarily from the top or upper surface downwardly. Applicant's arrangement not only insures that the cubes in sensing pockets 60' and 60'' freeze last but also promotes good ice cube release from the sensing pockets upon tray flexing during the harvesting cycle. The releasability of the ice cubes in pockets 60' and 60'' is a important feature as the inverted channel structure 291 together with adjacent boss structure 164 results in the pockets 60' and 60'' having increased stiffness providing resistance to tray flexing which could otherwise present an occasional stuck sensing cube condition during an ice harvesting cycle.

Figure 8:
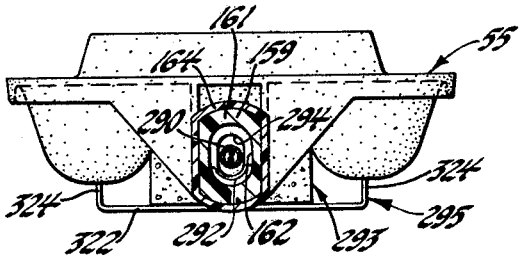
FIG. 8 is an end elevational view of the tray taken along the line 8—8 of FIG. 7.
Figure 10:
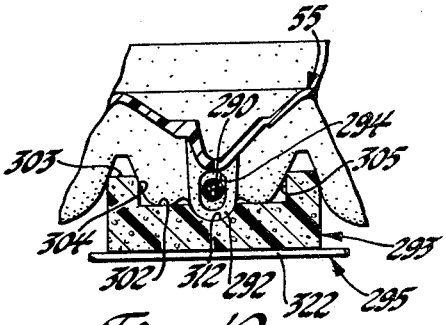
FIG. 10 is an end elevational view of the tray taken along the line 10—10 of FIG. 7.

As seen in FIGS. 8 and 9, securing means are provided for releasably retaining the insulation block on the tray. In the disclosed embodiment the securing means comprises a wire retainer 295 formed into a generally U-shaped hanger including a transverse bight portion 322 and equal upright leg portions 324 each terminating in an outwardly directed hook portion 326. As seen in FIG. 9, each hook portion 326 extends through an associated hole 328 formed in each of the outboard tray webs 330 which extend longitudinally between adjacent tray outer row pockets. The retainer 295 is dimensioned such that it only requires a slight springing force exerted on the legs 324 to enable its easy assembly while preventing the retainer and block 293 from being removed accidentally. Thus, the retainer 293 functions as the sole means for releasably retaining the insulation block 293 on the tray. The result is that the insulation block 293 is releasably retained on the tray in a sufficiently loose manner to permit relative movement between the block 293 and tray 55, whereby the block is shiftable with respect to the tray in response to the tray's twisting flexible movement during its ice harvesting rotation. This is an important feature in that the tray is free to flex each of its pockets, including the sensing pockets 60' and 60'', in a manner to insure the release of the ice pieces formed therein.

While the embodiment of the present invention as herein disclosed constitutes a preferred form, it is to be understood that other forms might be adopted.

I claim:

1. In an automatic ice maker including a support for rotatably supporting a flexible plastic ice tray for twistable movement, said tray being provided with at least three longitudinal rows of pockets therein including a center row of pockets oriented on the longitudinal rotational axis of said tray, said support having integral front end and rear end journal means for journaling the twistable flexible rotatable movement of said tray along said axis of rotation, said tray being further provided with integral front end journal connecting means comprising a boss on said tray front end forming a central cavity for reception of said front end journal means and an inverted channel extending from said central cavity along said axis of rotation in the bottom wall of at least the first and second pockets of said tray center row of pockets, means for filling said tray pockets with a charge of water, means for freezing the charge of water in the tray pockets into ice pieces, and means responsive to the temperature of the charge in said second pocket for rotating and twisting said tray when said charge is frozen whereby the frozen ice pieces are harvested from all the tray pockets and adapted for discharge into a receptacle, the improvement including an integrally molded open ended semi-cylindrical tray portion in communication with said central cavity and enclosing only the portion of said inverted channel formed in said first pocket to form a guide, a closed ended plastic tube having enclosed therein a temperature sensor, said tube extending sufficiently through said central cavity and said guide to position said temperature sensor in the portion of said inverted channel formed in the bottom wall of said second pocket, a separate rectangular sectioned block of insulation at least as long as said inverted channel and positioned on the underside of said tray's center row of pockets to provide a cover for said inverted channel thereby to enclose the temperature sensor outside said guide and adjacent said second pocket, said block having a recessed portion on its upper surface defined by peripheral side and back walls which conform to the underside of said first and second pockets to close the portion of said inverted channel formed in the bottom wall of said second pocket and isolate said temperature sensor, whereby said temperature sensor is insulated by said block from said freezing means so that said temperature sensor is sensitive only to the temperature of the charge in said second pocket, said block operative to insulate the bottom walls of said center row first and second pockets thereby insuring that the charge of water therein is not frozen into solid ice pieces prior to the freezing of the charge of water in the remaining tray pockets into solid ice pieces, and securing means for releasably retaining said insulation block on said tray sufficiently loosely to permit relative movement between said block and tray, whereby said block is shiftable with respect to said tray in reponse to twisting flexible movement of said tray during its rotation such that said tray is free to flex each tray pocket, including said second pocket, in a manner sufficient to insure the release of the ice pieces formed therein.

* * * * *